United States Patent [19]

Ishibashi

[11] Patent Number: 4,689,900

[45] Date of Patent: Sep. 1, 1987

[54] ANTISTATIC SHOE

[75] Inventor: Tokujiro Ishibashi, Tokyo, Japan

[73] Assignee: Nippon Rubber Co. Ltd., Tokyo, Japan

[21] Appl. No.: 651,074

[22] Filed: Sep. 17, 1984

[30] Foreign Application Priority Data

Sep. 17, 1983 [JP] Japan ..... 50-143960[U]

[51] Int. Cl.[4] ..... A43B 13/00

[52] U.S. Cl. ..... 36/103; 36/7.1 R; 36/30 A

[58] Field of Search ..... 36/103, 7.1 R, 1, 30 A, 36/43, 11.5; 361/223, 224; 128/80 DB, 581, 582

[56] References Cited

U.S. PATENT DOCUMENTS

| | | | |
|---|---|---|---|
| 957,394 | 5/1910 | Thoma | 36/30 A |
| 2,710,366 | 6/1955 | Stern | 36/1 |
| 2,712,099 | 6/1955 | Legge | 36/1 |
| 3,007,083 | 10/1961 | MacQuaid, Jr. et al. | 317/2 |
| 3,293,494 | 12/1966 | Fischer | 36/25 R |
| 3,381,173 | 4/1968 | Woskin | 36/1 |
| 3,383,559 | 5/1968 | Oesterheld | 36/1 |
| 3,406,316 | 10/1968 | Ito | 36/1 |
| 3,595,244 | 7/1971 | Kugler | 128/582 |
| 3,722,113 | 3/1973 | Birkenstock | 128/582 |
| 3,800,446 | 4/1974 | Pass | 36/7.1 R |
| 3,824,714 | 7/1974 | Glassman | 36/7.1 R |
| 3,859,727 | 1/1975 | Nakamoto | 128/582 |
| 4,033,054 | 7/1977 | Fukuoka | 128/582 |
| 4,047,310 | 9/1977 | Sunoo | 128/582 |
| 4,079,526 | 3/1978 | Fukuoka | 128/582 |
| 4,109,661 | 8/1978 | Fukuoka | 128/582 |
| 4,366,630 | 1/1983 | Bloom | 36/1 |

FOREIGN PATENT DOCUMENTS

| | | | |
|---|---|---|---|
| 2536967 | 6/1984 | France | 36/43 |
| 2619410 | 1/1977 | German Democratic Rep. | 128/582 |
| 3036263 | 4/1981 | German Democratic Rep. | 36/86 |
| 558340 | 12/1943 | United Kingdom | 36/1 |

*Primary Examiner*—Werner H. Schroeder
*Assistant Examiner*—Mary A. Ellis
*Attorney, Agent, or Firm*—Birch, Stewart, Kolasch and Birch

[57] ABSTRACT

An antistatic shoe including a sole having an insole and two soft antistatic projections corresponding to a medial plantar middle point and a medial calcanean point of the sole of an individual's foot. The projections are formed on the antistatic sole so as to be integrally therewith and project upwards through an insole. A charged static electricity accumulated on an individual's body and clothes is grounded to be effectively discharged through the two portions of the sole of the individual's foot. In addition, in the course of the foregoing grounding, the two portions are stimulated electrically by the electrostatic current to improve the circulation of the blood for promoting the health and development of the wearer.

7 Claims, 3 Drawing Figures

ANTISTATIC SHOE

BACKGROUND OF THE INVENTION

1. Field of the Invention

This invention relates to an antistatic shoe for effectively discharging charged static electricity from an individual.

2. Description of Background Art

In the present invention, the term medial planter middle point represents a portion a of the foot sole located just under the middle portion between a middle portion of the second toe bone c and a middle portion of the third toe bone d. The term medial calcanean point represents a portion b of the foot sole located just under the center portion of a heel bone e, as illustrated in FIG. 3.

The foregoing portions are called "Keiketu" and more specifically "yusen point" and "Shitsumin point" in oriental medical science, and it has been known that each portion has a function as a conduction control system or route for conducting various kinds of stimulations and is much better in electric conductivity than other portions of the foot sole.

A health shoe has been hitherto known wherein an upper surface of a sole thereof includes hard pressing projections, constructed of a magnet or a hard synthetic resin, and being positioned at the portions a and b of the sole of the foot, respectively. During wearing of the shoe, the portions a and b of the sole of the foot are stimulated by being pressed by the hard pressing projections for improving the circulation of the blood. However, this type of shoe is defective in that the pressing projections are hard making the wearing feeling very uncomfortable and in some occasions the portions a and b of the sole of the foot are injured thereby.

In addition, a type of antistatic shoe has been hitherto known wherein a shoe sole is made of an electrically conductive material. An insole is positioned on an upper surface of the shoe sole and is provided at several portions with electrically conductive small pieces which connect between the shoe sole and an upper surface of the insole. However, this type of shoe is defective in that the same is complicated in construction and high in price. The shoe is low in durability due to the fact that during wearing thereof the electrically conductive small pieces are liable to become disengaged.

SUMMARY AND OBJECTS OF THE INVENTION

It is an object of the present invention to remove the above defects. The present invention includes two soft antistatic projections corresponding to portions a and b of the sole of an individual's foot. The projections are formed on an antistatic sole so as to be integrally therewith and project upwards through an insole.

The antistatic shoe of the present invention is comfortable to wear and is excellent in durability. In addition, a charged static electricity accumulated on an individual's body and clothes is grounded to be effectively discharged through the portions a and b of the sole of the individual's foot. In addition, in the course of the foregoing grounding, the portions a and b are stimulated eletrically by the electrostatic current to improve the circulation of the blood for achieving promotion of health and development of physical strength.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed desription given hereinbelow and the accompanying drawings which are given by way of illustration only, and thus are not limitative of the present invention, and wherein.

DETAILED DESCRIPTION OF THE INVENTION

Figure 1:
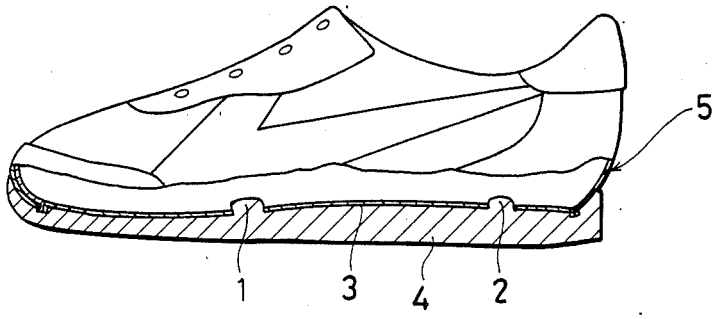
FIG. 1 is a side view, partly in section, of one example of the present invention.
Figure 2:
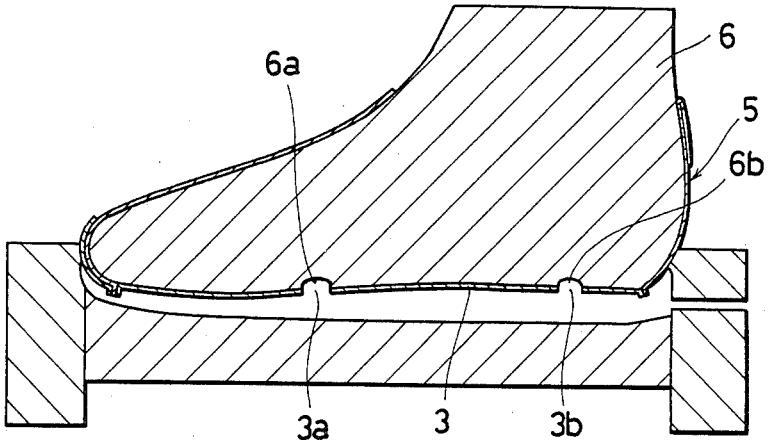
FIG. 2 is a sectional side view explaining a manufacturing process for a shoe sole.
Figure 3:
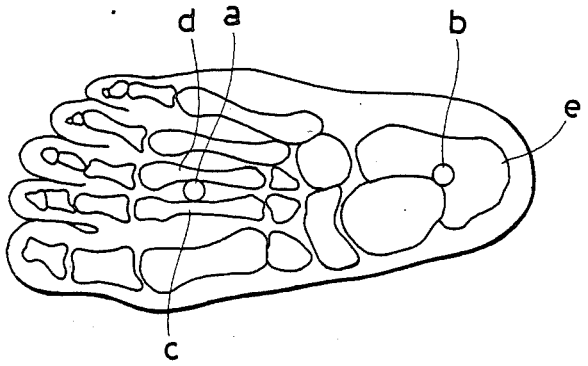
FIG. 3 is a top plan view of the sole of a foot showing positions a and b thereof.

Referring to the drawings, two soft antistatic projections 1, 2 are provided. An insole 3 is positioned adjacent an antistatic shoe sole 4. The two projections 1, 2 are so formed on the shoe sole 4 as to be integrally therewith and project through the insole 3 toward portions a and b of the sole of an individual's foot.

The antistatic projections 1, 2 and the antistatic shoe 4 are formed of a rubber or synthetic resin material that is in a range of $1.0\times10^5$–$1.0\times10^8$ ohm in its electric resistance value R, in accordance with JIS T 8103 (Japanese Industrial Standard relating to antistatic leather for safety working shoes).

If the projection 1 corresponding to the portion a is provided so as to be higher than the projection 2 corresponding to the portion b, in such a manner so as to be brought into contact with the arch shape of the portion a, the wearing feeling of the heel portion of the foot can be maintained by the projection 2. At the same time the pressing stimulation of the portion a by the projection 1 can become effective. Additionally, if the projections 1, 2 and the shoe sole 4 are formed, by expansion molding, integrally one with another, a shoe can be constructed which is light in weight and good in cushion property. Further, the projections 1, 2 at the time of wearing the shoe are more improved in compression deformation properties, so that the projections 1, 2 can be well deformed to fit the portion a and the poriton b for stimulating the portions a, b more effectively.

The shoe of the present invention may be manufactured in the following manner. At the time of forming an upper portion 5 on the insole 3, the insole 3 is provided, at the portions corresponding to the portion a and the portion b, with respective holes 3*a*, 3*b*. At the time of applying the upper portion 5 to a last 6, the holes 3*a*, 3*b* are positioned so as to face respective sunken portions 6*a*, 6*b* which have been previously formed in the bottom surface of the last 6 so as to predetermine the shape of the projections 1, 2 to be formed. Under these conditions the shoe sole 4 is formed by an injection molding in a conventional method. Thus, simultaneously with forming the shoe sole 4, the shoe sole forming material partly flows into the sunken portions 6*a*, 6*b* through the respective holes 3*a*, 3*b*. Therefore, since the shoe sole 4 and the projections 1, 2 are formed integrally one with another by this method, the forming operation thereof becomes simple and the forming cost can be remarkably lowered.

According to the present invention, the projections 1, 2 and shoe sole 4 are formed integrally one with another by using soft antistatic material. In this way a shoe can be produced which is comfortable to wear and is excellent in durability. Additionally, the projections 1, 2 are made of the soft antistatic materials and are provided so as to be located at portions corresponding to the portion a and the portion b. Thus, when an individual is wearing the shoe, the projections 1, 2 thereof are compressed by the individual's weight and consequently the contact areas thereof with the portion a and the portion b of the individual's foot can be increased. At the same time the portion a and the portion b are stimulated by the enlarged contact area thereof. Therefore, the static electricity accumulated on the wearer's body and clothes may be discharged to the ground more effectively from the portion a and the porion b, through the antistatic projections 1, 2 and the antistatic shoe sole 4.

As a result of the construction of the shoe, both the pressing stimulations by the projections 1, 2 and the electrical stimulations by the electrostatic currents flowing therethrough can be applied to the portion a and the porion b, so that the circulation of the blood of the wearer can be accelerated and the promotion of health and the development of physical strength can be achieved. In addition, during wearing thereof, electrostatic charging on the wearer's clothes and one's body can be prevented, so that electrostatic clinging of the clothes to the body can be effectively avoided. Additionally, the occurrence of an electrostatic spark can be prevented, so that the shoe is useful also as a working shoe.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An antistatic shoe comprising:

a sole;

an insole juxtapositioned relative to said sole, said insole including at least one aperture therein; and at least one soft compression deformable antistatic projection corresponding to a medial plantar middle point disposed at a middle portion of a foot between the second toe bone and the third toe bone of the sole of a foot, said projection extending through said aperture in said insole;

said sole and said at least one soft antistatic projection being formed of an antistatic foam material so as to be integral therewith and said projection projects upwards to extend through said aperture and above the insole to be compressed and to engage a substantial portion of the medial plantar middle portion of a foot;

said at least one soft antistatic projection and the antistatic shoe sole are constructed of rubber that has an electric resistance value in a range of $1.0\times10^5$–$1.0\times10^8$ ohm.

2. An antistatic shoe according to claim 1, wherein two soft antistatic projections are provided one corresponding to the medial plantar middle point and a second corresponding to the medial calcanean point.

3. An antistatic shoe comprising:

a sole;

an insole juxtapositioned relative to said sole, said insole including two apertures therein; and two soft compression deformable antistatic projections, a first projection corresponding to a medial plantar middle point disposed at a middle portion of a foot between the second toe bone and the third toe bone and a second projection corresponding to a medial calcanean point of the sole of a foot disposed just under a center portion of a heel bone;

said sole and said two soft antistatic portions being formed of an antistatic foam material so as to be integral therewith and said projections project upwards to extend through the apertures and above the insole to be compressed and to engage a substantial portion of the medial plantar middle point and the medial, calcanean point, respectively of a foot;

said two soft antistatic projections and the antistatic shoe sole are constructed of rubber that has an electric resistance value in a range of $1.0\times10^5$–$1.0\times10^8$ ohm.

4. An antistatic shoe comprising:

a sole;

an insole justapositioned relative to said sole, said insole including two apertures therein; and two soft compression deformable antistatic projections, a first projection corresponding to a medial plantar middle point disposed at a middle portion of a foot between the second toe bone and the third toe bone and a second projection corresponding to a medial calcanean point of the sole of a foot disposed just under a center portion of a heel bone;

said sole and said two soft antistatic portions being formed of an antistatic foam material so as to be integral therewith and said projections project upwards to extend through and above the apertures in the insole to be compressed and to engage a substantial portion of the medial plantar middle point and the media calcanean point, respectively, of a foot;

said projection corresponding to the medial plantar middle point is larger in height relative to the projection corresponding to the medial calcanean point;

5. An antistatic shoe comprising:

a sole;

an insole juxtapositioned relative to said sole, said insole including at least one aperture therein; and at least one soft compression deformable antistatic projection corresponding to a medial plantar middle point disposed at a middle portion of a foot between the second toe bone and the third toe bone of the sole of a foot, said projection extending through said aperture in said insole;

said sole and said at least one soft antistatic projection being formed of an antistatic foam material so as to be integral therewith and said projection projects upwards to extend through said aperture and above the insole to be compressed and to engage a substantial portion of the medial plantar middle portion of a foot;

said at least one soft antistatic projection and the antistatic shoe sole are constructed of synthetic resin that has an electric resistance value in a range of $1.0\times10^5$–$1.0\times10^8$ ohm.

6. An antistatic shoe comprising:

a sole;

an insole juxtapositioned relative to said sole, said insole including two apertures therein; and two soft compression deformable antistatic projections, a first projection corresponding to a medial plantar middle point disposed at a middle portion of a foot between the second toe bone and the third toe bone and a second projection corresponding to a medial calcanean point of the sole of a foot disposed just under a center portion of a heel bone;

said sole and said two soft antistatic portions being formed of an antistatic foam material so as to be integral therewith and said projections project upwards to extend through the apertures and above the insole to be compressed and to engage a substantial portion of the medial plantar middle point and the medial, calcanean point, respectively of a foot;

said two soft antistatic projections and the antistatic shoe sole are constructed of synthetic resin that has an electric resistance value in the range of $1.0^5$–$1.0\times10^8$ ohm.

7. An antistatic shoe comprising:

a sole;

an insole juxtapositioned relative to said sole, said insole including two apertures therein; and two soft compression deformable antistatic projections, a first projection corresponding to a medial plantar middle point disposed at a middle portion of a foot between the second toe bone and the third toe bone and a second projection corresponding to a medial calcanean point of the sole of a foot disposed just under a center portion of a heel bone;

said sole and said two soft antistatic portions being formed of an antistatic foam material so as to be integral therewith and said projections project upwards to extend through and above the apertures in the insole to be compressed and to engage a substantial portion of the medial plantar middle point and the medial calcanean point, respectively, of a foot;

said projection corresponding to the medial plantar middle point is larger in height relative to the projection corresponding to the medial calcanean point;

said two soft antistatic projections and the antistatic shoe sole are constructed of synthetic resin that has an electric resistance value in a range of $1.0\times10^5$–$1.0\times10^8$ ohm.

* * * * *

UNITED STATES PATENT AND TRADEMARK OFFICE

CERTIFICATE OF CORRECTION

PATENT NO. : 4,689,900

DATED : September 1, 1987

INVENTOR(S) : Tokujiro ISHIBASHI

It is certified that error appears in the above—identified patent and that said Letters Patent is hereby corrected as shown below:

Page 1, in the Heading , Under (30) Foreign Application Priority Data."

change "50 - 143960[U]"

to --58 - 143960[U]--

Signed and Sealed this

Twenty-fourth Day of May, 1988

*Attest:*

*Attesting Officer*

DONALD J. QUIGG

*Commissioner of Patents and Trademarks*